United States Patent [19]

Dickson et al.

[11] 4,006,605

[45] Feb. 8, 1977

[54] ICE MAKING MACHINE

[75] Inventors: George Dickson; Robert K. Westergaard, both of Alden, Minn.

[73] Assignee: King-Seeley Thermos Co., Ann Arbor, Mich.

[22] Filed: June 16, 1975

[21] Appl. No.: 587,531

[52] U.S. Cl. ..... 62/356; 62/347; 29/446; 249/119

[51] Int. Cl.[2] ..... F25C 1/04

[58] Field of Search ..... 62/74, 347, 348, 356; 249/119, 127; 29/446, 157.3 C; 277/106, 263, 138, 12, 309; 403/263, 240, 244; 248/1, 346; 55/502

[56] References Cited

UNITED STATES PATENTS

| | | | |
|---|---|---|---|
| 2,645,095 | 7/1953 | Ploeger | 62/356 X |
| 3,721,071 | 3/1973 | Mueller et al. | 55/502 X |
| 3,791,163 | 2/1974 | Dickson et al. | 62/347 |

*Primary Examiner*—William F. O'Dea
*Assistant Examiner*—William E. Tapolcai, Jr.
*Attorney, Agent, or Firm*—Harness, Dickey & Pierce

[57] ABSTRACT

An ice making machine comprising a refrigeration system for supplying refrigerant to an evaporator assembly associated with a plurality of inverted ice forming molds or cups having a water spray bar located therebelow; ice formed in the cups is delivered to a bin mounted on a pivotable door structure which is selectively removable in order to provide for access to the ice producing equipment and refrigeration system for purposes of service, repair, cleaning and the like; the plurality of cups being mounted in a plastic platen which is cooperable with the evaporator assembly of the refrigeration system; a control system is provided for selectively energizing the condenser fan motor and for actuating a water pump to supply water to the ice in the inverted cups during the harvest cycle, whereby to maintain the refrigerant pressure at a desired level and accelerate the harvest cycle.

16 Claims, 10 Drawing Figures

FIG. 5.
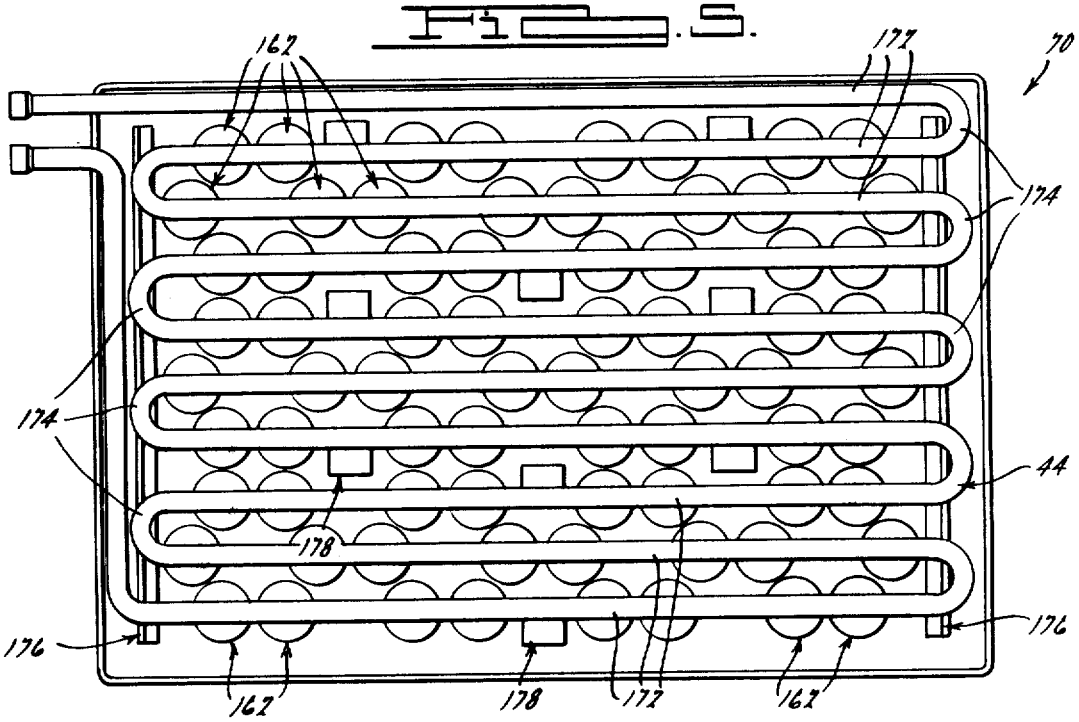
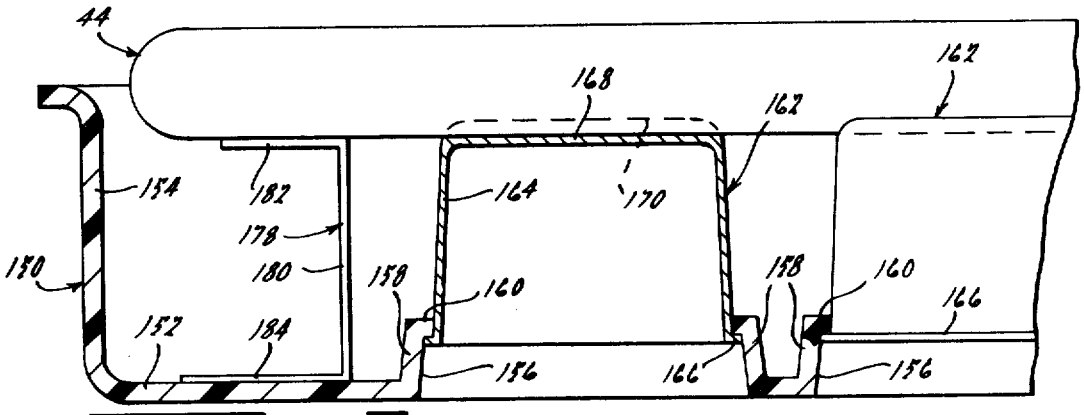
FIG. 6.
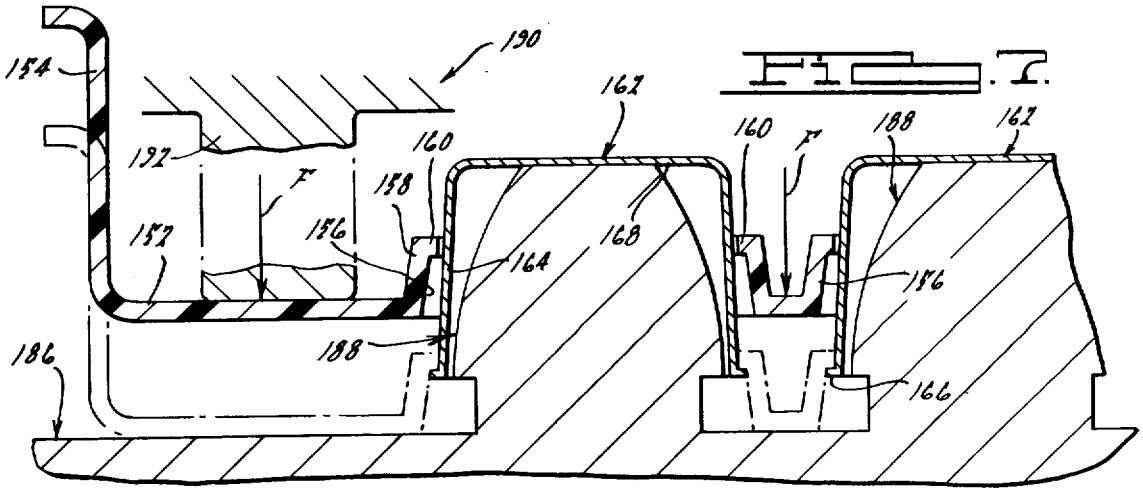
FIG. 7.

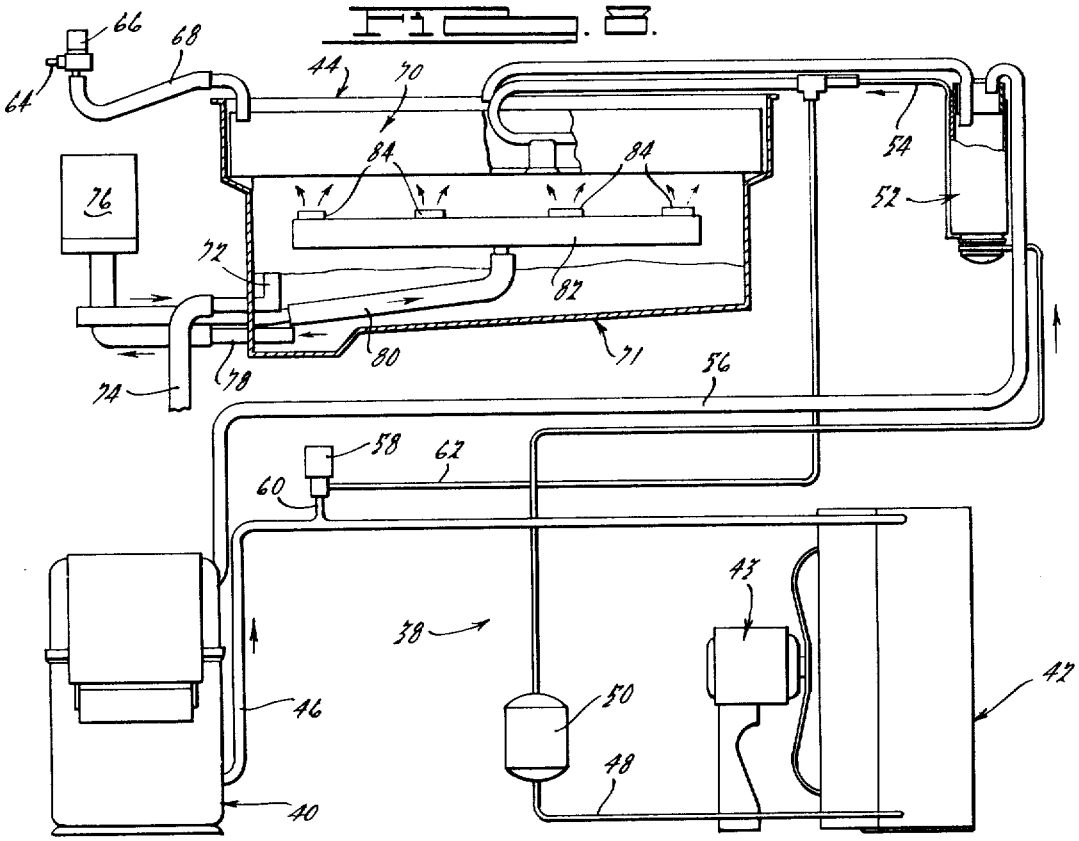
FIG. 8.
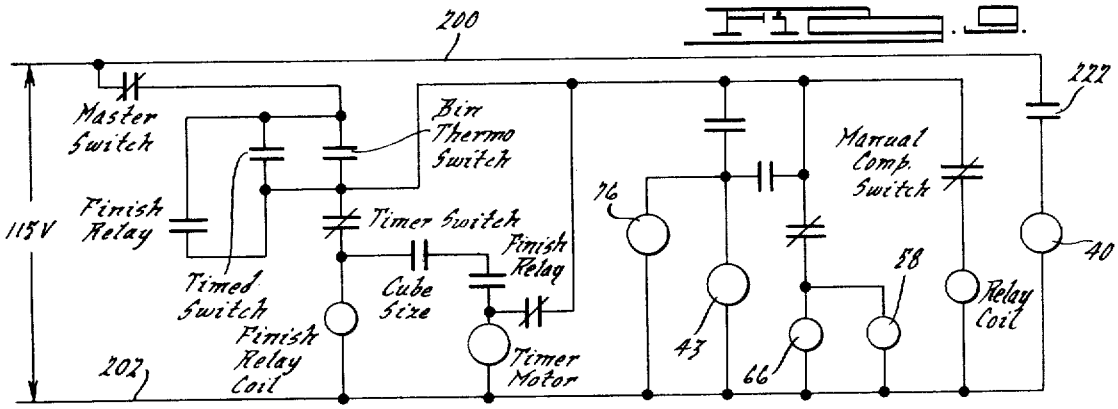
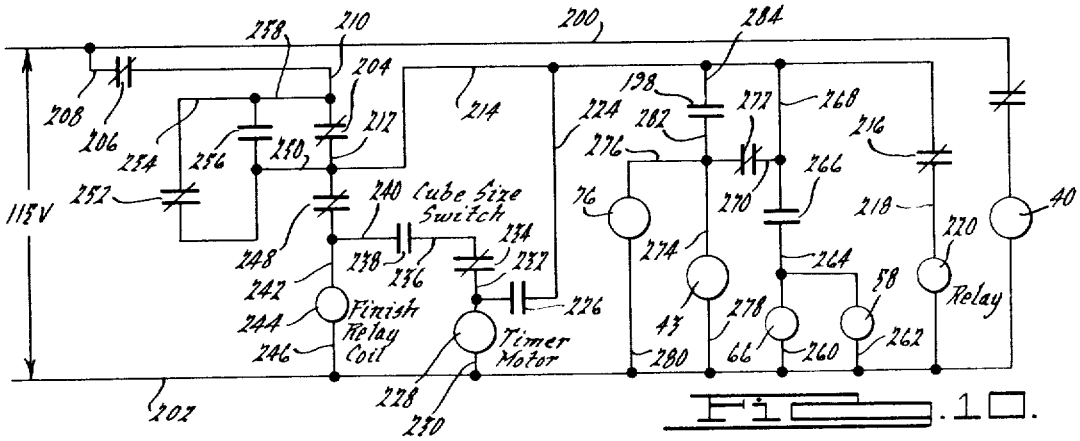
FIG. 10.

ICE MAKING MACHINE

BACKGROUND AND SUMMARY OF THE INVENTION

U.S. Pat. Nos. 2,949,019; 3,465,537; 3,559,424 and U.S. Pat. Nos. Re. 26,101, 3,791,163, all of which patents are assigned to the assignee herein, disclose various types of ice making machines for producing ice in cube or similar form within a plurality of inverted ice forming molds or cups adapted to have water sprayed thereinto by means of a water spraying device located therebelow. During harvesting of the ice, the cubes formed within the cups drop downwardly into a storage chute or bin to which suitable access is provided.

The present invention is generally related to ice making machines of the above-described character; however, the apparatus of the present invention incorporates a number of improvements over the various types of ice making machines shown in such prior art. In particular, the present invention embodies a novel housing or enclosure having an ice storage bin that is mounted on the interior side of a tiltable access door or panel, whereby the door may be tilted or pivoted from its normal closed position to an open position to provide for access to the ice stored within the bin. The door and storage bin are mounted in a manner such that they may be conveniently removed from the ice making machine cabinet in order to provide for convenient access to the various ice making and refrigeration components therewithin, thus providing for convenient servicing, repair, cleaning and the like.

Another area of improvement of the present invention over the aforementioned patents resides in the construction and method of assembly of the combination platen and refrigeration evaporator assembly incorporated therein. In particular, the plurality of ice forming cups are mounted within a platen structure which is fabricated of a plastic or polymeric material and which is assembled with the cups in a manner so as to assure against any water leaking between the cups and the associated peripheral portions of the platen structure.

Another area of improvement of the present invention resides in the provision of a novel electrical control circuit which includes a pressure sensitive switch located in the high side pressure line of the refrigeration compressor and adapted to selectively control operation of the water pump for actuating the water spray bar during the harvest cycle and thereby accelerate the defrost or harvest or portion of the operational cycle of the present invention by utilizing such water to supplement the hot refrigerant gases which are communicated through the refrigeration evaporator during the harvest cycle. The pump motor, on air cooled versions of the present invention, is intended to be operable concomitantly with the condenser fan so that the fan will maintain acceptable refrigerant pressures, which pressures, under high ambient temperature conditions, may surge to cause excessive power requirements. Additionally, it is desirable to operate the condenser fan in order to prevent the refrigerant temperatures from rising too high during the harvest cycle since any excess heat in the refrigeration evaporator must be subsequently removed during the following freezing cycle; hence, by operating the condenser fan, refrigerant temperatures are maintained at an acceptable level so as to minimize cycle time.

It is accordingly a general object of the present invention to provide a new and improved ice making machine.

It is a more particular object of the present invention to provide a new and improved ice making machine which has a reduced cycle time and thus a larger ice producing capacity than comparable machines in the prior art.

It is still a more particular object of the present invention to provide a new and improved ice making machine of the above character which utilizes an electrical control circuit that selectively energizes the water pump motor during the harvest cycle so that make-up water can be used in conjunction with the hot gas defrost system in accelerating harvest time.

It is a related object of the present invention to operate the pump motor concomitantly with the condenser fan for maintaining acceptable refrigerant pressure levels during the harvest cycle.

It is a further object of the present invention to provide an ice making machine of the above character having a new and improved platen assembly and method of manufacturing the same.

It is still a further object of the present invention to provide an ice making machine of the type having a tiltable access door, which door is conveniently removable to provide for servicing, repair, etc., of the associated ice making and refrigeration components.

It is a further object of the present invention to provide a new and improved ice making machine of the above-described type that will have a long and effective operational life and which may be easily and economically manufactured.

Other objects and advantages of the present invention will become apparent from the following detailed description, taken in conjunction with the accompanying drawings.

BRIEF DESCRIPTION OF THE DRAWINGS

FIG. 5 is a top elevational view of the combination evaporator and platen assembly incorporated within the ice making machine of the present invention;

FIG. 6 is an enlarged fragmentary cross-sectional view of the portion of the assembly shown in FIG. 5;

FIG. 7 is a view similar to FIG. 6 and illustrates the method of assembling the ice forming cups in the platen assembly of the ice making machine of the present invention;

FIG. 8 is a schematic representation of the refrigeration and ice make-up water system incorporated in the ice making machine of the present invention; and FIGS. 9 and 10 are schematic representations of the electrical control circuit incorporated in the ice making machine of the present invention.

DETAILED DESCRIPTION OF THE PREFERRED EMBODIMENTS

Figure 1:
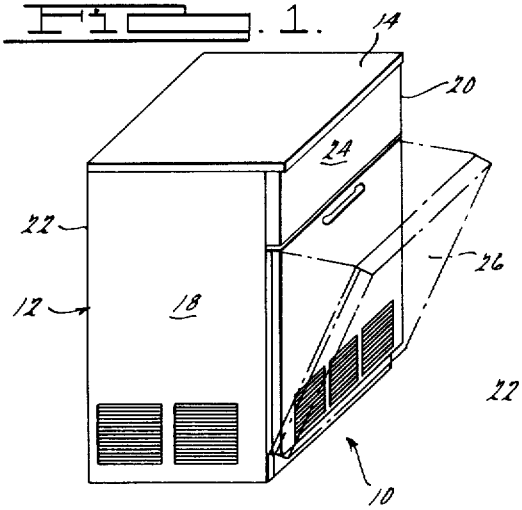
FIG. 1 is an elevated perspective view of one preferred embodiment of the ice making machine of the present invention.
Figure 2:
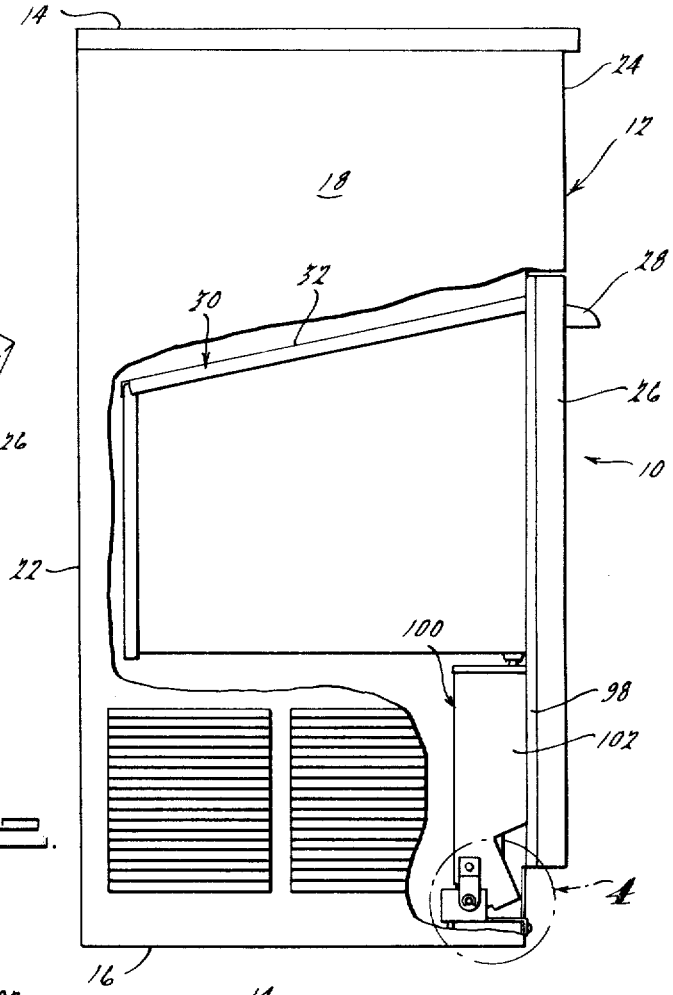
FIG. 2 is an enlarged side elevational view, partially broken away, of the ice making machine shown in FIG. 1.
Figure 4:
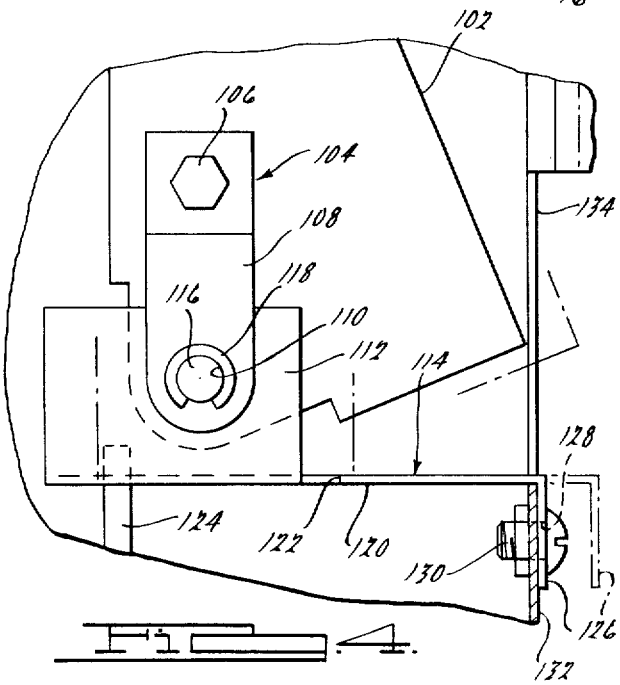
FIG. 4 is an enlarged fragmentary cross-sectional view of the structure shown within the circle 4 of FIG. 2.
Figure 3:
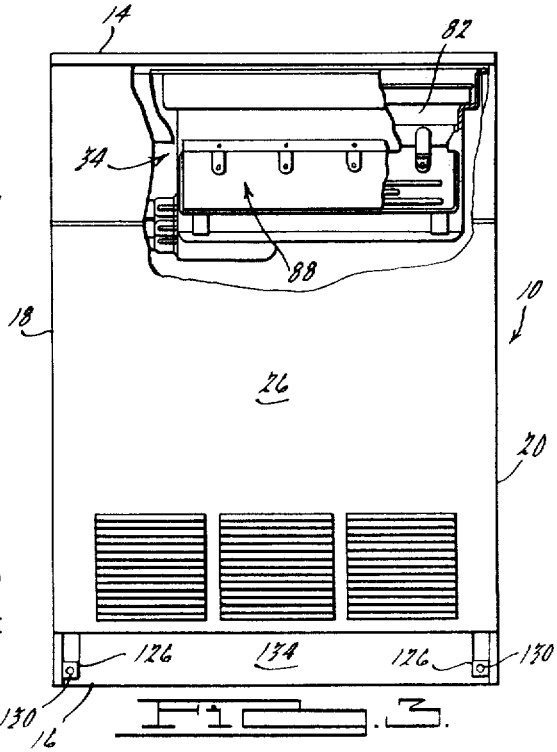
FIG. 3 is a front elevational view, partially broken away, of the ice making machine shown in FIGS. 1 and 2.

Referring now in detail to the drawings and in particular to FIGS. 1–3 thereof, an ice making machine 10, in accordance with one preferred embodiment of the present invention, is shown generally as comprising an external housing or casing 12 which is of a generally parallel-piped configuration and consists of a top 14, bottom 16, laterally spaced side walls 18 and 20, a back wall or side 22 and a front side 24. The front side 24 is provided with a pivotable or tiltable access door 26 having a manually graspable handle 28 on the exterior side thereof and provided with an ice receiving and storage bin 30 on the inner side thereof. As best seen in FIG. 2, the bin 30 extends substantially the entire distance from the front wall 24 to the back wall 22 and is provided with an open upper side 32 adapted to receive ice in cube or other suitable form from an ice making apparatus, generally designated by the numeral 34, that is located within the housing 12 above the bin 30, as best seen in FIG. 3. As will be appreciated by those skilled in the art, ice that is produced by the apparatus 34 will drop downwardly into and be stored within the bin 30. At such time as access to the ice is desired, the door 24 may be tilted or pivoted about a generally horizontally extending axis from the solid line position shown in FIG. 1 to the phantom line position shown in this Figure, whereby convenient access may be provided to the ice within the bin 30 through the open upper side 32 thereof.

As schematically illustrated in FIG. 8, the ice making machine 10 of the present invention comprises a generally conventional refrigeration system 38 including a compressor 40, condenser 42 and evaporator 44. The compressor 40 is communicable via a discharge line 46 with the condenser 42 which is provided with an electrically energized cooling fan 43. The refrigerant supplied to the condenser 42 is communicated via a conduit 48 and a conventional refrigerant dryer 50 to a refrigerant accumulator assembly 52 which may be of any conventional construction having conduits 54 and 56 communicable with the evaporator 44 and compressor 40, respectively. An electrically energized hot gas valve 58 is communicable via conduits 60 and 62 with the discharge line 46 and conduit 54, respectively. As will be appreciated by those skilled in the art, the refrigeration system 38 functions in a conventional manner such that gaseous refrigerant at relatively high pressure is supplied by the compressor 40 to the condenser 42, the refrigerant being cooled and liquified as it passes through the condenser 42. The thus cooled and liquified refrigerant flows from the condenser 42 to the evaporator 44, where the refrigerant is vaporized by the transfer of heat from water within the ice producing apparatus 34 which is being formed into ice. The gaseous refrigerant then flows from the evaporator 44 back to the inlet or suction side of the compressor 40 through the conduit 56 for recycling.

The make-up water system of the ice making machine 10 includes a water inlet line 64 which is adapted to be communicable with any suitable source of potable water. The inlet line 64 is communicable with an electrically energized water solenoid valve 66 which is in turn communicable via a water conduit 68 with the interior of a platen assembly, generally designated by the numeral 70. Water is communicated from the assembly 70 to a water sump or reservoir 71 located below the assembly 70 and having a standpipe 72 which is communicable with a system drain line 74. The water system also includes an electrically energized water pump 76 having an inlet line 78 communicable with the interior of the reservoir 71 and an outlet line 80 communicable with a relatively fixedly mounted spray manifold 82 having a plurality of upwardly directed discharge spray nozzles 84 which function to spray make-up water upwardly toward the underside of the platen assembly 70 during the freezing cycle of the ice making machine 10.

During the harvest portion of the operational cycle, fresh water is communicated via the inlet line 64, solenoid 66 and conduit 68 to the interior of the platen assembly 70, which water thereafter flows to the reservoir 71 for make-up water during the next freezing cycle. During this harvest portion of the operational cycle, the ice cubes that have been formed within the platen assembly 70 drop downwardly past an ice deflecting curtain 88 (see FIG. 3) through the open upper side 32 of the bin 30 for subsequent dispensing.

In accordance with one feature of the present invention, the door 26 is provided with a door frame, generally designated by the numeral 98, which is provided with a pair of hinge assemblies, generally designated 100, at the lower laterally opposite sides thereof. Each of the assemblies 100 comprises a hinge member 102 that has a hinge bracket 104 secured to the laterally outer side thereof by means of a suitable bolt or the like 106. The hinge brackets 104 are provided with laterally outwardly offset lower end portions 108 which are formed with openings 110 that register with aligned openings (not shown) in the hinge members 102. The space between the end portions 108 and the associated hinge members 102 receive vertically upright portions 112 of a pair of mounting brackets 114 disposed directly below each of the hinge assemblies 100. Suitable hinge pins 116 or the like extend through the openings 110 and aligned openings in the bracket portions 112 and lower ends of the hinge members 102, for pivotably connecting the hinge members 102 and hence the door 26 to the mounting brackets 114. Suitable snap rings or the like may be provided on the laterally opposite ends of the pins 116 for retaining the pins 116 in place. Each of the mounting brackets 114 comprises a generally horizontally extending portion 120 which is formed with a rearwardly opening recess or slot 122. The slots 122 are adapted to nestingly receive generally vertically disposed positioning pins or elements which are secured to the main frame of the housing 12. The mounting brackets 114 also comprise downwardly extending forward mounting tabs 126 which are formed with central openings 128 through which suitable screws or similar fastening devices 130 extend for securing the tabs 126 and hence the mounting brackets 114 to the laterally opposite ends of a relatively flat horizontal surface 132 defined in the toe receiving area 134 of the housing 12.

The screws 130 and pin elements 124 normally fixedly secure the mounting brackets 114 to the main frame of the housing 12 in a manner such that the door 26 and bin 30 may be pivoted to and from the solid and phantom line positions shown in FIG. 1. At such time as it is desired to remove the door 26 and bin 30 mounted thereon, assuming that the bin drain conduit (not shown) is disconnected, the screws 130 associated with each of the mounting brackets 114 are removed, whereby the entire door 26 and bin 30 can be withdrawn along with the mounting brackets 114. With this arrangement, convenient access is provided to the refrigeration system 38 and ice producing apparatus 34 once the door 26 is removed for purposes of service, repair and the like. Consequently, the entire housing 12 may be built into associated cabinetry without in any way inhibiting convenient servicing of the internal component of the machine 10. After the servicing has been completed, the mounting brackets 114 may be repositioned by sliding the same into surmounting relationship with the pin elements 124 and the screws 130 may be reinstalled, thereby securing the entire door 26 in its desired operative position. It is to be noted that it may be desired to cover the forward sides of the mounting brackets 114 with a suitable cover plate or the like for purposes of appearance, although such plate has not been shown herein so as to not obscure the disclosure of the present invention.

Referring now in detail to the construction of the platen assembly 70 as best seen in FIGS. 5–7, the assembly 70 comprises a generally rectangular-shaped platen member 150 having a bottom portion 152 and a peripheral upstanding side wall 154. The platen 150 is preferably fabricated of a molded plastic material, such as, for example, ABS plastic, which has a high density and is resistant to having ice adhering to the underside thereof. The bottom portion 152 is formed with a plurality of rows of annular openings, each of which is defined by a generally upwardly and radially inwardly extending flange portion 158 having a radially inwardly extending shoulder 160 around the terminal upper end thereof. Associated with each of the openings 156 is an inverted ice forming cup or mold which is preferably fabricated of a high heat transfer metallic material, such as copper or a suitable copper alloy. Each of the cups 162 includes an annular side wall 164 having a radially outwardly extending peripheral shoulder 166 on the lower end thereof and terminating at the upper end thereof in a closed top portion 168. The upper ends or top portions 168 of the cups 162 are recessed and are adapted to nestingly receive or engage associated elongated parallel sections 170 of the evaporator 44 which are aligned with the rows of cups 162. As shown in FIG. 5, the parallel sections 172 of the evaporator 44 are connected by reverse bend portions 174, whereby the evaporator 44 assumes a generally surpentine configuration as illustrated. The evaporator 44 is supported upon laterally spaced main support brackets 176 which bear upon the bottom section 152 of the platen 150. Additionally, a plurality of spacer elements 178 are interspersed along the evaporator sections 172 between the bottom section 152 of the platen 150 and the underside of the evaporator 44. As seen in FIG. 6, each of the spacer elements 178 comprises a generally vertical leg portion 180, a top flange portion 182 adapted to be secured to the evaporator 44 and a bottom flange portion 184 adapted to bear against the bottom section 152 of the platen 150.

In accordance with the principles of the present invention, the platen assembly 70 is adapted to be constructed in a manner so as to provide for a positive seal between the shoulders 160 and 166, whereby to provide against undesirable water leakage between the exterior of the cups 162 of the openings 156. Such method of assembly includes the initial step of providing a mandrel support structure having a base 186 and a plurality of upright spaced apart mandrels 188 which are arranged in the pattern which the cups 162 ultimately assume in the assembly 70. Each of the mandrels 188 is adapted to have one of the inverted cups 162 placed thereon in the manner shown in FIG. 7, and thereafter, the platen 150 is arranged so that the openings 156 register with the cups 162. A suitable fixture representatively designated by the numeral 190 in FIG. 7 is then moved relative to the mandrel base 186 such that a plurality of outwardly projecting fingers, one of which is shown in FIG. 7 and identified by the numeral 192, apply a force against the platen 150 so as to cause the platen 150 to move relative to the cups until such time as the shoulders 160 around each of the openings 156 tightly engages the shoulder 166 of the associated cups 162. Such force applied by the fixture 190 is representatively indicated by the arrows F in FIG. 7. After the platen 150 is properly positioned upon the plurality of cups 162, the fixture 190 is opened and the main support brackets 176 and plurality of spacer elements 178 are positioned upon the platen 150. The evaporator 44 is thereafter placed on top of the brackets 176, spacer elements 178 and cups 162 and the fixture 190 is again moved toward a closed position, i.e., toward the mandrel base 186, whereupon a compressive force is applied to the brackets 176 and spacer elements 178. While this compressive force is being applied, the cups 162 are connected, as by soldering or the like to the respective sections 172 of the evaporator 44, after which time the fixture 190 is opened and the completed evaporator assembly 70 may be removed for subsequent installation. In accordance with the present invention, by applying a compressive force to the brackets 176 and spacer elements 178 as the evaporator 44 is being secured to the cups 162, the shoulders 160 and 166 will be positively and sealingly engaged with one another and will remain so engaged throughout the life of the assembly 70 so as to assure against any relative movement of the cups 162 with respect to the platen 150 and thereby provide against any undesirable water leakage therebetween.

In operation of the ice making machine 10, during each defrost or harvest cycle, water is introduced into the upper side of the platen 150 by means of the conduit 68 and this water flows out of the platen 150 through a plurality of weep holes (not shown), which communicate the water to the reservoir 71. The size of the weep holes are selected such that the water drains from the platen 150 at a slightly slower rate than it is introduced thereto so that a temporary accumulation of water occurs within the platen 150. This wave functions to raise the temperature of the plastic material from which the platen 150 is fabricated and thus aid in the release of any ice which may have been formed on and adhered to the underside of the platen 150 during the preceding freezing cycle. Additionally, during the defrost or harvest cycle, hot refrigerant gas is communicated through the evaporator 44 upon opening of the hot gas valve 58, whereby to raise the temperature of the cups 162 and thus permit the ice cubes that have been formed therein to drop downwardly toward and into the bin 30. It will be noted that such hot gas defrost systems are well known in the art and no further description of the hot gas defrosting principle is believed to be necessary and has been omitted herein for purposes of conciseness of description.

As disclosed in U.S. Pat. No. 3,791,163, it is desirable to apply water to the frozen ice cups during the harvest cycle in order to accelerate the harvest period; however, in view of the fact that the discharge nozzles 84 are fixedly mounted (as opposed to being rotatable as mentioned in the 3,791,163 patent), a continuous operation of the spray nozzles during the harvest cycle would cause excessive melting of the ice. Accordingly, it is desirable to intermittently apply water to the ice by means of the nozzles 84 during the harvest portion of the cycle and means for thus operating the water pump 76 on an intermittent basis is provided in accordance with the principles of the present invention. In particular, a high pressure switch is located in the electrical and refrigeration systems of the ice making machine 10 which operates in response to the refrigerant pressure on the high (discharge) side of the compressor 40. At such time as the pressure reaches a predetermined magnitude, approximately at 150 psi, the switch will close to complete a circuit to the water pump 76. The control circuit to the water pump is associated with the circuit for operating the condenser cooling fan 43 in those types of applications wherein the condenser 42 is air cooled (as opposed to being water cooled), whereby the fan 43 operates concomitantly with the water pump 76 on an intermittent basis during the harvest cycle. This arrangement provides two additional advantages in that by flowing additional air over the condenser 42, refrigerant temperature and pressure are maintained at a lower level so as to assure against electrical current surge demands and to minimize the rise in temperature in the evaporator which occurs during the harvest cycle. In this regard, it should be noted that it is desirable to prevent an excessive rise in temperature during the harvest cycle in the evaporator, since excess heat must be removed during the next subsequent freezing cycle and hence by preventing excessive heat build-up in the evaporator during the harvest cycle, overall cycle time is minimized. A more detailed description of the operation of the refrigeration and electrical systems is hereafter provided for more complete understanding of the concepts disclosed herein.

The electrical circuit of the ice making machine 10 consists of primary conductors 200 and 202 which are connected to a suitable source of electrical energy, such as a 115-volt source, and includes a thermostatic bin switch 204 which is located within the bin 30 and is normally open, but closes at such time as a predetermined volume of ice cubes has been deposited into the bin 30. The circuit further includes a master switch 206 which is connected to conductor 202 through conductor 208 and is connected to the bin thermostatic switch through conductor 210. Switch 204 is connected through conductors 212 and 214 to a manually operated compressor control switch 216 which is normally closed and is utilized primarily during cleaning operations. The switch 216 is connected through conductor 218 to a compressor control relay coil 220 which operates a relay switch 222 that is normally open and which closes upon energization of the coil 220. Conductor 214 is connected through conductor 224 and relay switch 226 with a timer motor 228 which is in turn connected through conductor 230 to primary conductor 202. The motor 228 is also connected to conductor 232 through relay switch 234 and conductor 236 with a cube size switch 238. The switch 238 is open during initiation of a freezing cycle and closes when the size of the cubes being formed reaches a predetermined value as is well known in the art. Switch 238 is connected through conductors 240 and 242 with a finish relay coil 244 which is in turn connected through conductor 246 with primary conductor 202. Conductor 242 is connected through a timer switch 248 with conductor 212 and is also connected through conductor 250 with a finish relay switch 252. The switch 252 is connected through conductor 254 with a timer switch 256 which is in turn connected through conductor 258 with conductor 210. The water solenoid 66 and hot gas defrost valve 58 are connected through conductors 260 and 262 with primary conductor 202 and are connected through conductor 264 and a finish relay switch 266 and conductor 268 with conductor 214. The conductor 268 is connected through conductor 270 and finish relay switch 272 and conductors 274, 276 with the fan motor 43 and water pump 76, respectively. The fan motor 43 and pump 76 are also connected through conductors 278 and 280 with the primary conductor 202. The conductor 276 is connected via conductor 282 to the high pressure control switch 198 which is in turn connected to conductor 214 via conductor 284.

In operation of the ice making machine 10 of the present invention, assuming that the master switch is closed and that the bin thermostatic switch is open and that the timer switches 248 and 256 are in their respective positions shown in FIG. 9 and that the finish relay switches 252, 234, 226, 266 and 272 are also in their respective condition shown in FIG. 9, a typical operational cycle is initiated by closing the bin thermostatic control switch which occurs when the bin 30 requires additional ice. When this occurs, the circuit is completed to the relay coil 220 through the primary conductor 202 and conductor 200 and conductor 210, switch 204, conductor 214, switch 216 and conductor 218, resulting in energization of the relay 220 and closing of the switch 222, whereby the compressor 40 is energized. At the same time, a circuit is completed to the finishing relay coil 244 through primary conductor 202 and conductor 210, switch 204, normally closed timer switch 248 and conductor 242. When this occurs, the finish relay switches 252, 234, 226, 272 and 266 change from the condition shown in FIG. 9 to the condition shown in FIG. 10, whereby a circuit is completed to the water pump 76 and fan motor 43 through conductor 202 and conductor 210, switch 204, conductors 214, 268, 270, switch 272 and conductors 274 and 276, thus initiating the freezing cycle wherein water is sprayed upwardly into the platen assembly 70 so that ice cubes form in the cups 162.

After the ice cubes reach a predetermined size, the cube size switch will close, thereby completing a timing circuit to the timer motor 228 through conductors 202 and 230 and conductors 210, switch 204, conductor 212, switch 248, conductor 240, switch 238, conductor 236, switch 234 and conductor 232. The timer motor 228 controls operation of the timer switches 256 and 248 and at the end of a predetermined period of time, for example, approximately six minutes, the normally opened switch 256 closes and the normally closed switch 248 will open. When this occurs, the defrost or harvest cycle will be initiated. In particular, when the timer switch 248 opens, the relay coil 244 will be deenergized and the finish relay switches 252, 234, 226, 272 and 266 will change from the condition shown in FIG. 10 back to the condition shown in FIG. 9, whereby the circuit to the water pump 76 and fan motor 43 will be opened and a circuit will be completed to the water solenoid 66 and hot gas valve 58 through conductor 202 and conductors 210, switch 204, conductor 214, conductor 268, switch 266 and conductor 264. It will be noted that the timer motor 228 will continue to operate during the defrost cycle and that a circuit is completed to the motor 228 via the conductor 202 and conductor 224 and closed relay switch 226. During the defrost period, the compressor pressure will use a predetermined magnitude and the high pressure switch 198 will therefore close, whereupon a circuit will be completed to the water pump 76 and fan motor 43 through conductor 202, conductor 214, switch 198 and conductors 274 and 276. Accordingly, the flow of air across the condenser 42 will reduce the refrigerant pressure, and at the same time, water will be sprayed onto the lower sides of the ice cubes to aid in the defrosting or release thereof from their respective cups or molds. When the pressure drops, the switch 198 will again open thereby opening the circuit to the fan motor 43 and water pump 76 to effect de-energization thereof. It is contemplated that during a typical defrost or harvest cycle, the motor 43 and pump 76 may turn on and off several times, depending upon ambient temperature conditions.

At the end of the defrost cycle, the term of which is determined by the timer motor 228, for example, 2 minutes, the timer switches 256 and 248 will respectively open and close, thereby completing one full operational cycle of the machine 10. In the event the bin 30 is full of ice and the bin switch 204 is open, the entire system will be deenergized; however, in the event the bin switch remains closed indicating that additional ice is needed in the bin 30, an identical operational cycle, as hereinabove described, will be started. It is to be noted that the purpose of the finish relay switch 252 is to assure that a complete operational cycle takes place even though, for some reason or another, ice may be added to the bin 30 from some external source causing the bin thermostatic switch to open. Additionally, it is to be noted that the purpose of the finish relay switches 226 and 234 is to assure that the timer motor 228 continues to be energized during the defrost cycle even though the finish relay coil 244 is deenergized.

It will be seen from the foregoing that the present invention provides a novel ice making machine which may be easily serviced, cleaned, etc., through the provision of the removable door 26 that may be disassembled in order to provide for convenient access to the interior components of the machine 10. Additionally, the present invention embodies a new and improved platen assembly which assures against inadvertent water leakage between the platen members and associated ice forming cups which arrangement has the further advantage of providing for increased ice volume within the ice cups as compared to prior known designs. Finally, the present invention utilizes a novel control system wherein water may be periodically sprayed against the frozen ice in order to accelerate the harvest cycle, and at the same time, the condenser fan may be intermittently operated in order to maintain refrigerant temperature and pressures at an acceptable level. All of the aforesaid features are accomplished without any excessive complexity in the design and mode of operation, thereby providing an ice making machine that is economical to manufacture and which will have a long and effective operational life.

While it will be apparent that the preferred embodiment illustrated herein is well calculated to fulfill the objects above stated, it will be appreciated that the present invention is susceptible to modification, variation and change without departing from the scope of the invention.

We claim:

1. A combination evaporator and platen subassembly for an ice making machine, said subassembly comprising a platen member having a bottom portion and an upstanding peripheral wall portion, said bottom portion being formed with a plurality of openings, a plurality of inverted cup-shaped molds disposed one in each of said openings, an evaporator having portions arranged adjacent each of said cups and secured thereto, and means for urging said cups into positive sealing engagement with the peripheral portions of said openings, said last mentioned means including means disposed between said evaporator and said platen member and normally exerting a force urging said evaporator away from said platen bottom portion and thereby causing said sealing engagement between said cups and said platen.

2. The invention as set forth in claim 1 wherein said platen is fabricated of a plastic material and wherein said molds are fabricated of a metallic material.

3. The invention as set forth in claim 1 wherein said molds are arranged in rows that are oriented generally parallel to said evaporator portions.

4. The invention as set forth in claim 1 wherein said last mentioned means includes a plurality of spacer elements interposed between said platen and said evaporator portions.

5. The invention as set forth in claim 1 wherein the tops of said molds are soldered to said evaporator portions.

6. The invention as set forth in claim 1 wherein said molds are formed with radial shoulders which are engageable with radial shoulders formed around the periphery of said openings.

7. The invention as set forth in claim 4 wherein said spacer elements have lower end portions bearing against the upper side of said platen and upper end portions bearing against said evaporator.

8. A combination evaporator, platen and ice mold comprising, a platen member having a bottom portion and an upstanding peripheral wall portion, said bottom portion being formed with a plurality of openings, a plurality of inverted cup-shaped molds disposed one within each of said openings, an evaporator having portions arranged adjacent each of said cups and fixedly secured thereto, and at least one member interposed between the upper surface of said platen bottom portion and said evaporator and normally maintained in a state of compression for urging said evaporator away from said platen and thereby causing said molds to be biased into sealing engagement with said platen openings.

9. The invention as set forth in claim 8 wherein said element includes a lower portion secured to said platen, an upper portion secured to said evaporator and an intermediate portion extending between said upper and lower portions.

10. The invention as set forth in claim 8 wherein said element comprises one of a plurality of elements normally maintained under a state of compression interjacent said platen and said evaporator.

11. The invention as set forth in claim 8 which includes at least one support bracket for supporting said evaporator on said platen.

12. The invention as set forth in claim 8 wherein said evaporator has a plurality of spaced parallel sections, and wherein said openings are arranged in rows aligned with said evaporator sections, and wherein each of said molds is formed with a peripheral flange adapted to sealingly engage a peripheral shoulder formed around the associated of said openings.

13. The invention as set forth in claim 12 which includes a pair of support brackets extending generally transversely of said evaporator sections.

14. The invention as set forth in claim 13 wherein said element comprises one of a plurality of spacer elements disposed between said support brackets and exerting a force against said evaporator to bias the same away from said platen.

15. The invention as set forth in claim 14 wherein each of said spacer elements includes a lower portion secured to said platen, an upper portion exerting said force against said evaporator and an intermediate portion normally maintained under a state of compression and extending between said upper and lower portions.

16. The invention as set forth in claim 15 wherein said evaporator sections are secured to said molds by soldering.

* * * * *